United States Patent [19]

Kato et al.

[11] Patent Number: 5,001,029

[45] Date of Patent: Mar. 19, 1991

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 299,496

[22] Filed: Jan. 23, 1989

[30] Foreign Application Priority Data

Jan. 20, 1988 [JP] Japan ..... 63-8446

[51] Int. Cl.[5] ..... G03G 5/087

[52] U.S. Cl. ..... 430/49; 430/96

[58] Field of Search ..... 430/49, 96

[56] References Cited

U.S. PATENT DOCUMENTS 4,456,679 6/1984 Leyrer et al. ..... 430/280

4,828,952 5/1989 Kato et al. ..... 430/96

*Primary Examiner*—John Goodrow

*Attorney, Agent, or Firm*—Sughrue, Mion, Zinn, Macpeak & Seas

[57] ABSTRACT

An electrophotographic lithographic printing plate precursor which utilizes an electrophotographic photoreceptor comprising a conductive support having provided thereon at least one photoconductive layer containing photoconductive zinc oxide and a resin binder, wherein said resin binder comprises at least one resin which contains at least one functional group capable of producing at least one hydroxyl group through decomposition and is crosslinked in part to bring about improvements in background-stain resistance and printing durability.

In accordance with this invention, electrophotographic lithographic printing plate precursors excellent in background stain resistance and printing durability are obtained.

8 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor for producing a printing plate through electrophotography and, more particularly, to an improved binder resin constituting a photoconductive layer of said lithographic printing plate precursor.

BACKGROUND OF THE INVENTION

A number of offset printing plate precursors for directly producing printing plates have hitherto been proposed, some of which have already been put into practical use. The most widely employed precursor is a photoreceptor having a photoconductive layer comprising photoconductive particles, such as zinc oxide, and a resin binder provided on a conductive support. A highly lipophilic toner image is subsequently formed on the photoconductive layer surface by an electrophotographic process. The toner image formed on the surface of the photoreceptor is then treated with an oil-desensitizing solution, called an etching solution, to selectively render the non-image areas hydrophilic thus producing an offset printing plate.

In order to obtain satisfactory prints, an offset printing plate precursor or photoreceptor must faithfully reproduce an original on the surface thereof; the photoreceptor surface should have a high affinity for an oil-desensitizing solution so as to render non-image areas sufficiently hydrophilic and, at the same time, should be water resistant. When used as printing plate, the photoconductive layer having a toner image formed thereon should adhere during printing, and should be receptive to dampening water so that the non-image areas can remain sufficiently hydrophilic to be free from stains, even after a large number of prints have been reproduced from the plate.

These properties are effected by the proportion of zinc oxide to resin binder in the photoconductive layer. Specifically, when the proportion of zinc oxide particles to resin binder in the photoconductive layer is decreased, the oil-desensitivity of the photoconductive layer surface is enhanced and background staining is decreased. However, the internal cohesive force and mechanical strength of the photoconductive layer itself is lowered resulting in the deterioration of the printing impression. On the contrary, when the proportion of a resin binder is increased, the background stain is increased although the printing impression is heightened. Background staining is related to the oil-desensitivity of the photoconductive layer surface. Not only does the ratio of zinc oxide to resin binder in the photoconductive layer influence the oil-desensitivity, but the oil-desensitivity also depends on the type of the resin binder employed.

Resins for use in photoreceptors include silicone resins as disclosed in JP-B-34-6670 (the term "JP-B" as used herein means an "examined Japanese patent publication"), styrene-butadiene resins as disclosed in JP-B-35-1950, alkyd resins, maleic acid resins and polyamides as disclosed in JP-B-35-11219, vinyl acetate resins as disclosed in JP-B-41-2425, vinyl acetate copolymers as disclosed in JP-B-41-2426, acryl resins as disclosed in JP-B-35-11216, acrylic acid ester copolymers as disclosed in JP-B-35-11219, JP-B-36-8510, JP-B-41-13946, etc. However, electrophotographic photoreceptors employing these resins each have various problems including (1) low chargeability of the photoconductive layer, (2) poor image reproducibility (in particular, dot reproducibility and resolving power), (3) low photoreceptivity, (4) insufficient oil-desensitivity of the photoconductive layer surface resulting in generation of background stains on the prints when offset printing is performed, even when subjected to an oil-desensitizing treatment for producing an offset master, (5) insufficient film strength of the photoconductive layer, resulting in loss of adhesion upon offset printing and fewer prints, and (6) sensitivity of the image quality to the environment at the time of image reproduction (e.g., high temperature and high humidity condition).

With respect to the offset master, the background stain resulting from insufficiency in oil-desensitization is a particularly serious problem. For the purpose of solving this problem, various binder resins in combination with zinc oxide have been developed for the prospect of enhancing the oil-desensitivity. Resins which enhance oil-desensitivity of the photoconductive layer include those discussed as follows: JP B-50-31011 discloses a resin having a molecular weight of from $1.8\times10^4$ to $1.0\times10^5$ and a glass transition point (Tg) of from 10° C. to 80° C., and which is prepared by copolymerizing a (meth)acrylate monomer and another monomer in the presence of fumaric acid, with a copolymer prepared from a (meth)acrylate monomer and a monomer other than fumaric acid; JP-A-53-54027 (the term "JP-A" as used herein means an "unexamined published patent application") discloses a ternary copolymer comprising a (meth)acrylic acid ester having a substituent which contains a carboxylic acid group apart from the ester linkage by at least 7 atoms; JP-A-54-20735 and JP-A-57-202544 disclose quaternary or quinary copolymers comprising acrylic acid and hydroxyethyl (meth)acrylate; and JP-A-58-68046 discloses a ternary copolymer comprising a (meth)acrylic acid ester having an alkyl group containing 6 to 12 carbon atoms as a substituent and a vinyl monomer containing a carboxylic acid group. However, even with the use of the above-described resins, which are said to enhance oil-desensitivity, the resulting offset masters are not sufficiently resistant to background stain, printing impression, etc. from a practical point of view.

On the other hand, resins of the type which contain functional groups capable of producing hydrophilic groups through decomposition have been examined as candidates for the resin binder. For example, the resins containing functional groups capable of producing hydroxyl groups by decomposition are disclosed in JP-A-62-195684, JP-A-62-210475 and JP-A-62-210476, and those containing functional groups capable of producing carboxyl groups through decomposition are disclosed in JP-A-62-21269.

These techniques disclose resins which produce hydrophilic groups by hydrolysis or hydrogenolysis in the presence of an oil-desensitizing solution or dampening water used during printing When used as resin binder for lithographic printing plate precursors, these resins are said to mitigate various problems including the aggravation of surface smoothness, the deterioration of electrophotographic characteristics, etc. These problems are thought to be caused by the strong interaction between the released hydrophilic groups and the surface of photoconductive zinc oxide particles when resins originally containing hydrophilic groups themselves are used as the resin binder. In addition, the affinity of the non-image part for water, rendered hydrophilic by an oil-desensitizing solution, is said to be further strengthened by the aforesaid hydrophilic groups produced by decomposition of the resins to make a clear distinction between the lipophilic image part and the hydrophilic non-image part. At the same time, these resins are said to prevent printing ink from adhering to the non-image part upon printing thereby enabling printing of a large number of clear prints free from background stains.

Even these resins, however, do not fully prevent background staining Satisfactory printing impression is also not fully realized. Specifically, when such hydrophilic group-producing resins are used in a large proportion to further improve the affinity of the non-image part for water, the durability of the resulting printing plate is impaired. The hydrophilic groups produced by decomposition render the non-image part soluble in water while increasing the affinity for water.

Accordingly, methods were needed for further enhancing the affinity of the non-image part for water while at the same time improving durability.

SUMMARY OF THE INVENTION

The above-described shortcomings have been satisfied by an electrophotographic lithographic printing plate precursor employing an electrophotographic photoreceptor comprising a conductive support having provided thereon at least one photoconductive layer containing photoconductive zinc oxide and a resin binder, said resin binder comprising at least one resin having at least one functional group capable of producing at least one hydroxyl group through decomposition and said resin is crosslinked at least in part, thus achieving the present invention.

The present invention is characterized by the resin binder constituting the photoconductive layer of a lithographic printing plate precursor, which contains at least one functional group capable of producing at least one hydroxyl group through decomposition, and at least a part of which is crosslinked. According to the present invention, the lithographic printing plate precursor has superior characteristics in that it reproduces copies faithful to an original, does not generate background stains owing to a strong affinity of the non-image part for water, has excellent smoothness and electrostatic characteristics of the photoconductive layer, and further provides a prominent printing impression.

Moreover, the lithographic printing plate precursor of the present invention is not sensitive to environmental influences during the plate-making process, and is stable in storage.

DETAILED DESCRIPTION OF THE INVENTION

Resins containing at least one functional group capable of producing at least one hydroxyl group through decomposition (which are simply called resins containing hydroxyl group-producing functional groups, at times hereinafter), which can be used in the present invention, are described in detail below.

Functional groups contained in the resins to be used in the present invention produce hydroxyl groups through decomposition, and one or more hydroxyl groups may be produced from one functional group.

In accordance with a preferred embodiment of this invention, the resins containing hydroxyl group-producing functional groups are those containing at least one kind of functional group represented by the general formula (I): —O—L In the general formula (I), L represents

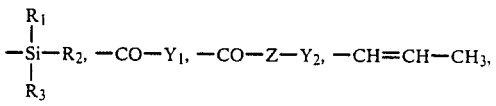

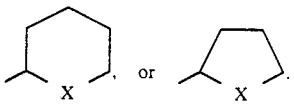

Therein, $R_1$, $R_2$ and $R_3$ may be the same or different, and each represents a hydrogen atom, a hydrocarbon residue, or —O—R′ (R′=a hydrocarbon residue); $Y_1$ and $Y_2$ each represents a hydrocarbon residue; Z represents an oxygen atom, a sulfur atom or —NH— group; and X represents a sulfur atom, or an oxygen atom.

The functional groups of the foregoing general formula —O—L, which produce a hydroxyl group through decomposition, are described in greater detail.

In the case where L represents

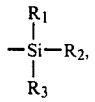

$R_1$, $R_2$ and $R_3$ may be the same or different, each preferably representing a hydrogen atom, an optionally substituted straight or branched chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group (e.g., cyclopentyl, cyclohexyl), an optionally substituted aralkyl group containing 7 to 12 carbon atoms (e.g., benzyl, phenethyl, fluorobenzyl, chlorobenzyl, methylbenzyl, methoxybenzyl, 3-phenylpropyl), an optionally substituted aryl group (e.g., phenyl, naphthyl, chlorophenyl, tolyl, methoxyphenyl, methoxycarbonylphenyl, dichlorophenyl), or —O—R′ (wherein R′ represents a hydrocarbon residue, with specific examples including the same ones cited above as examples of $R_1$, $R_2$ and $R_3$).

In the case where L represents —CO—$Y_1$, $Y_1$ preferably represents an optionally substituted straight or branched chain alkyl group containing 1 to 6 carbon atoms (e.g., methyl, trichloromethyl, trifluoromethyl, methoxymethyl, phenoxymethyl, 2,2,2-trifluoroethyl, t-butyl, hexafluoro-i-propyl), an optionally substituted aralkyl group containing 7 to 9 carbon atoms (e.g., benzyl, phenethyl, methylbenzyl, trimethylbenzyl, heptamethylbenzyl, methoxybenzyl), or an optionally substituted aryl group containing 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

In the case where L represents —CO—Z—$Y_2$, Z is an oxygen atom, a sulfur atom, or a —NH— linkage group; and $Y_2$ has the same meaning as the foregoing $Y_1$.

In the case where L represents

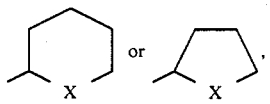

X represents an oxygen atom or a sulfur atom.

The resins containing at least one kind of functional group selected from those of the general formula —O—L can be prepared using a method which involves converting hydroxyl groups contained in a polymer to the functional group represented by the general formula —O—L according to the high-molecular reaction, or a method which involves polymerizing one or more of a monomer containing one or more of a functional group of the general formula —O—L, or copolymerizing one or more of said monomer and other copolymerizable monomers according to a conventional polymerization reaction.

The high-molecular reaction is disclosed in Yoshio Iwakura and Keisuke Kurita, *Hannosei Kobunshi (Reactive High Molecules)*, p. 158, Kodansha, Tokyo, and methods of converting a hydroxyl group contained in a monomer to the functional group represented by the general formula —O—L are described in detail, e.g., in Nihon Kagakukai (ed.), *Shin-Jikken Kagaku Koza*, vol. 14, "Yuki Kagobutsu no Gosei to Han-no (V)", p. 2497, Maruzen K.K.

The method of preparing a polymer from monomers previously containing functional groups of the general formula —O—L in accordance with a polymerization reaction is preferred, because functional groups to be introduced into the polymer can be readily controlled such that the prepared polymer is not contaminated with impurities, etc. These monomers can be prepared by converting at least one hydroxyl group contained in a compound having a polymerizing double bond into the functional group of the general formula —O—L according to methods as described above, or by reacting a compound containing the functional group of the general formula —O—L with a compound having a polymerizing double bond.

The monomers containing the functional groups of the general formula —O—L to be used, as described above, in preparing a desired resin by a polymerization reaction include, for example, compounds represented by the following general formula (II).

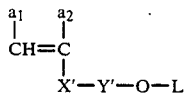

(II)

wherein X' represents —O—, —CO—, —COO—, OCO—,

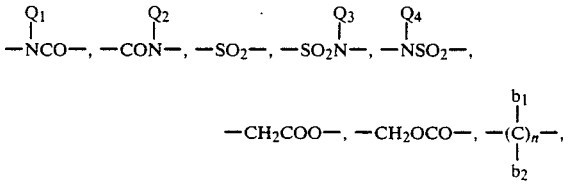

an aryl group, or a heterocyclyl group (wherein $Q_1$, $Q_2$, $Q_3$ and $Q_4$ each represent a hydrogen atom, a hydrocarbon residue, or the moiety —Y'—O—L in formula (II); $b_1$ and $b_2$ may be the same or different, each being a hydrogen atom, a hydrocarbon residue or the moiety —Y'—O—L in formula (II); and n is an integer of from 0 to 18); Y' represents carbon-carbon bond(s) for connecting the linkage group X' to the functional group —O—L, between which hetero atoms (e.g., oxygen, sulfur, nitrogen) may be present, specific examples including

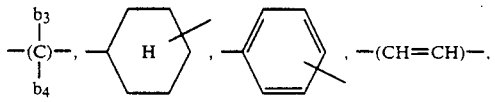

and combinations of one more of these groups with —O—, —S—,

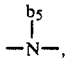

—COO—, —CONH, —$SO_2$—, —$SO_2$NH—, —NHCOO— or/and —NHCONH—(wherein $b_3$, $b_4$ and $b_5$ each have the same meaning as the foregoing $b_1$ or $b_2$); L has the same meaning as in the formula (I); and $a_1$ and $a_2$ may be the same or different, each being a hydrogen atom, a hydrocarbon residue (e.g., an alkyl group containing 1 to 12 carbon atoms, which may be substituted with —COOH or so on), —COOH or —COO—W (wherein W represents an alkyl group containing 1 to 18 carbon atoms, an alkenyl group, an aralkyl group, an alicyclic group or an aryl group, each of which may be substituted with a group containing the functional group of the formula —O—L).

Specific but non-limiting examples of monomers containing the functional group of the general formula —O—L are illustrated below, wherein Me represents a methyl group.

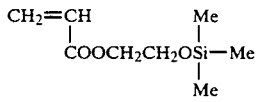

(1)

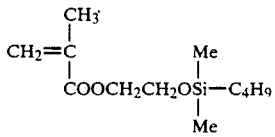

(2)

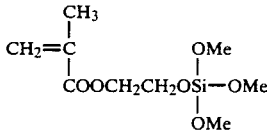

(3)

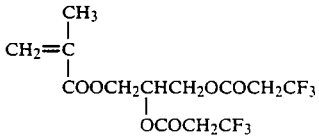

(4)

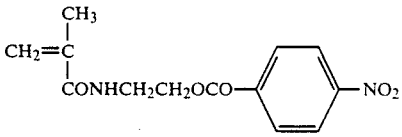

(5)

-continued (6)

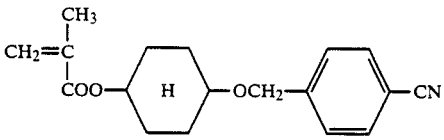

(7)

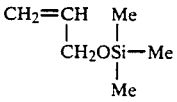

(8)

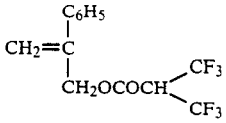

(9)

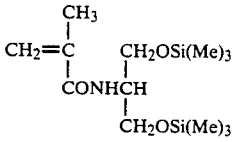

(10)

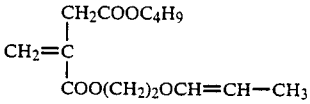

(11)

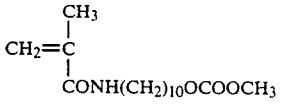

(12)

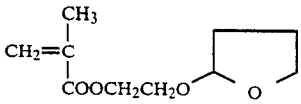

(13)

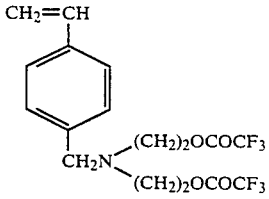

(14)

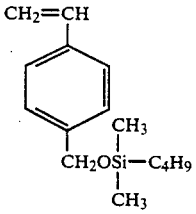

(15)

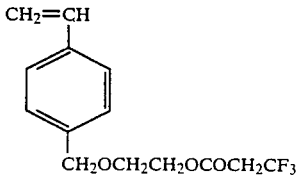

(16)

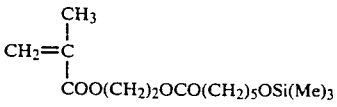

-continued (17)

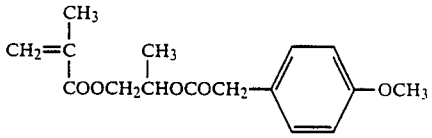

(18)

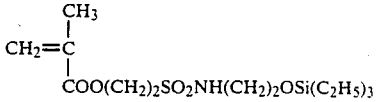

(19)

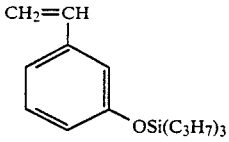

(20)

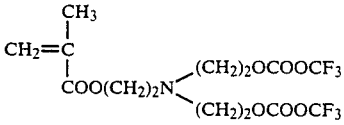

(21)

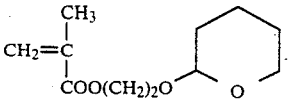

(22)

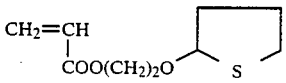

(23)

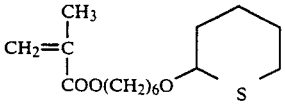

(24)

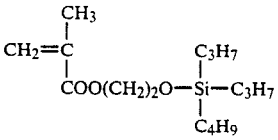

These monomers may be either homopolymerized or copolymerized with other copolymerizable monomers. Suitable examples of other copolymerizing monomers include vinyl or allyl esters of aliphatic carboxylic acids, such as vinyl acetate, vinyl propionate, vinyl butyrate, allyl acetate, allyl propionate, etc.; esters or amides of unsaturated carboxylic acids such as acrylic acid, methacrylic acid, crotonic acid, itaconic acid, maleic acid, fumaric acid, etc.; styrene derivatives such as styrene, vinyl toluene, α-methylstyrene etc.; α-olefins; acrylonitrile; methacrylonitrile; and vinyl-substituted heterocyclic compounds such as N-vinylpyrrolidone, etc.

In accordance with another preferred embodiment of the present invention, the resins containing hydroxyl group-producing functional groups are those containing at least one kind of functional group which has at least two hydroxyl groups located in a position sterically next to each other in such a form as to both be protected by a single protecting group. Specific examples of such functional groups are those represented by the following general formulae (III), (IV) and (V):

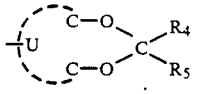

(III)

(wherein $R_4$ and $R_5$ may be the same or different, each being a hydrogen atom, a hydrocarbon residue, or —O—O—R″ (wherein R″ represents a hydrocarbon residue); and U represents a carbon-carbon chain in which a hertero atom may be introduced (provided that the number of atoms present between the two oxygen atoms does not exceed 5)

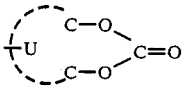

(IV)

(wherein U has the same meaning as in (III)

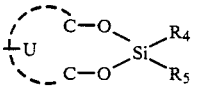

(V)

(wherein $R_4$, $R_5$ and U have the same meanings as in (III), respectively).

These functional groups are more specifically described below.

In the formula (III), $R_4$ and $R_5$ may be the same or different, and each preferably represents a hydrogen atom, an alkyl group containing 1 to 12 carbon atoms, which may be substituted (e.g., methyl, ethyl, propyl, butyl, hexyl, 2-methoxyethyl, octyl), an aralkyl group containing 7 to 9 carbon atoms, which may be substituted (e.g., benzyl, phenethyl, methylbenzyl, methoxybenzyl, chlorobenzyl), an alicyclic residue containing 5 to 7 carbon atoms (e.g., cyclopentyl, cyclohexyl), an aryl group, which may be substituted (e.g., phenyl, chlorophenyl, methoxyphenyl, methylphenyl, cyanophenyl), or —O—R‴ (wherein R‴ represents the same hydrocarbon residue as $R_4$ and $R_5$).

U represents a carbon-carbon chain in which hetero atoms may be introduced, provided that the number of atoms present between the two oxygen atoms does not exceeding 5.

Resins containing functional groups of at least one kind for use in the present invention are prepared in accordance with a method which involves utilizing a high-molecular reaction. As such, the hydroxyl groups in a polymer which are located in a position sterically next to each other are transformed such that they are protected by a protecting group. Methods which involve polymerizing a monomer which contains prior to polymerization at least two hydroxyl groups protected by a protecting group, or copolymerizing said monomer and other copolymerizing monomers in accordance with a polymerization reaction may also be used in the present invention.

In the former preparation method which utilizes a high-molecular reaction, polymers having a repeating unit as illustrated below, which have at least two hydroxyl groups adjacent to each other or one hydroxyl group in such a position as to be near a hydroxyl group in another unit as the result of polymerization, for example,

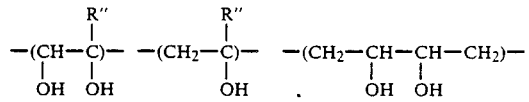

(i) (ii) (iii)

(wherein R″ represents H, or a substituent groups such as $CH_3$)

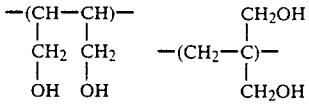

(iv) (v)

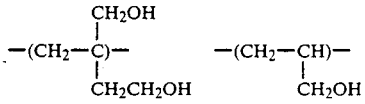

(vi) (vii)

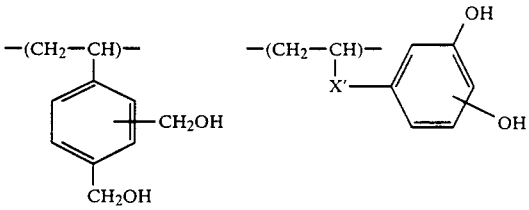

(viii) (ix)

(X′ = linkage group)

or the like, are made to react with a carbonyl compound, an ortho ester compound, a halogen-substituted formic acid ester, a dihalogenated silyl compounds, or the like to result in formation of the intended functional groups having at least two hydroxyl groups protected by the same protecting group. More specifically, such polymers can be prepared in accordance with known methods described in, e.g., Nihon Kagakukai (ed.), *Shin-Jikken Kagaku Koze*, vol. 14, "Yuki Kagobutsu no Gosei to Han-no (V)", p. 2505, Maruzen K.K., and J.F.W.Mc. Omie, *Protective Groups in Organic Chemistry*, chaps. 3 to 4, Plenum Press.

In the latter method, monomers initially having at least two protected hydroxyl groups are first prepared in accordance by methods cited in the aforementioned publications, and then polymerized, if desired, in the presence of other copolymerizing monomers in a conventional polymerization process to obtain a homopolymer or a copolymer.

Specific but non-limiting examples of the repeating units having the foregoing kind of functional groups to be present in the polymers of this invention are shown as follows:

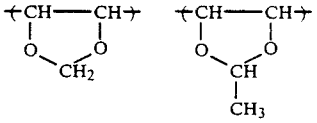

(25) (26)

-continued
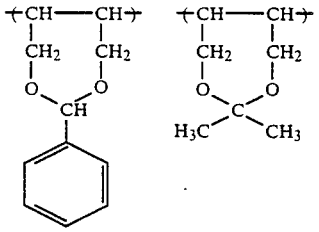
(27) (28)
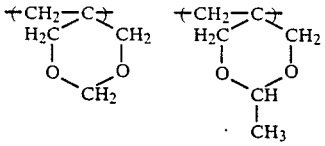
(29) (30)
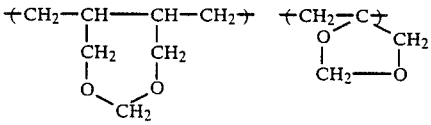
(31) (32)
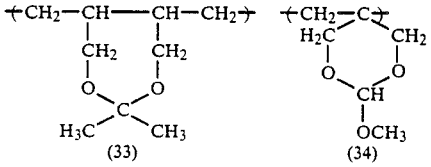
(33) (34)
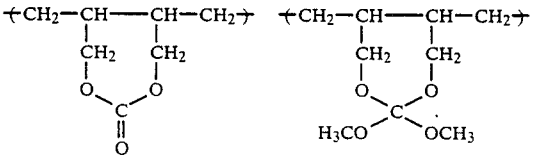
(35) (36)
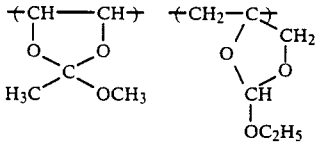
(37) (38)
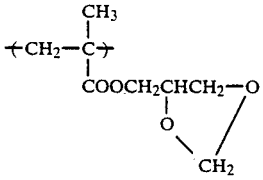
(39)
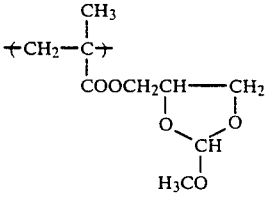
(40)
-continued
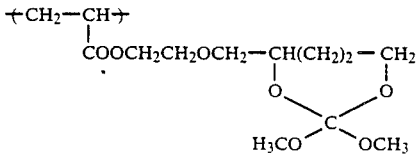
(41)
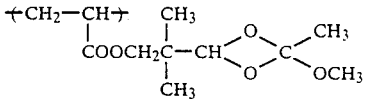
(42)
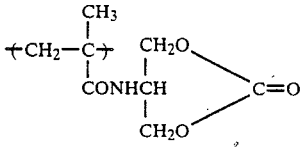
(43)
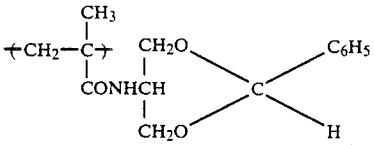
(44)
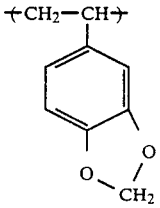
(45)
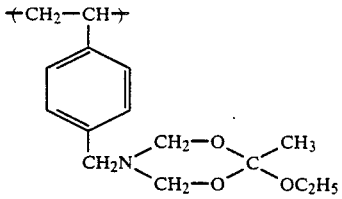
(46)
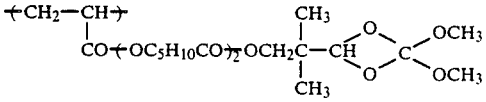
(47)
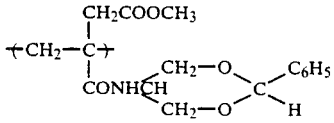
(48)

-continued

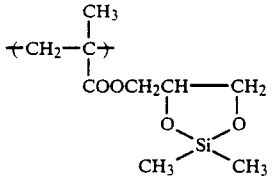

(49)

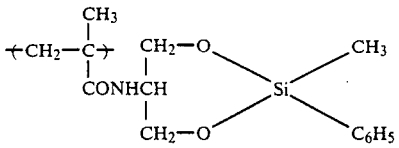

(50)

When the resin of the present invention is a copolymer, a preferred proportion of the repeating unit containing a hydroxyl group-producing functional group ranges from 1 to 95 wt%, particularly from 5 to 60 wt%, with respect to all units in the copolymer. A suitable molecular weight of the copolymer resin ranges from about $1\times10^3$ to about $1\times10^6$, preferably from $5\times10^3$ to $5\times10^5$, more preferably from $3\times10^4$ to $4\times10^5$.

The resin of the present invention is further characterized by cross-linkages formed at least in part among resin molecules when the resin constitutes an electrophotographic lithographic printing plate precursor.

In order to obtain partial cross-linkage as described above, a previously cross-linked polymer may be used at the stage of coating a photoreceptive layer-forming composition during the plate-making process, or a heat and/or light curable resin containing cross-linkable functional groups may be used and cross-linked in the course of producing a lithographic printing plate precursor (e.g., in the drying step), or these resins may be used together.

The amount of a component containing cross-linkable functional groups is preferably from about 0.1 to about 10% by weight, when the cross-linkable group are copolymer components containing polymerizable double bonds, or from about 1 to about 80% by weight, when the cross-linkable groups are copolymer components containing cross-linkable groups other than the polymerizable double bonds.

In using a resin previously cross-linked in part (i.e., a resin having a cross-linking structure among polymer molecules) as resin binder, the resin preferably should become slightly soluble or insoluble in an acidic or alkaline aqueous solution when the foregoing hydroxyl group-producing functional groups contained in the resin are decomposed to produce hydroxyl groups.

More specifically, preferred resins have solubilities of 50 g or less, particularly 30 g or less, in 100 g of distilled water at 25° C. The solubility of the resin as defined herein means the solubility after the resin has been subjected to the oil-desensitization treatment.

In introducing a cross-linking structure into polymer molecules of a resin, conventional methods can be employed.

For example, a method of polymerizing monomer(s) in the presence of a polyfunctional monomer can be employed, and a method of introducing functional groups capable of promoting a cross-linking reaction into polymers and cross-linking these polymers by high-molecular reaction can be employed.

For the introduction of a cross-linking structure in the resin of this invention, functional groups capable of undergoing a self cross-linking reaction, represented by —$CONHCH_2OR'$ (wherein R' is a hydrogen atom or an alkyl group), or cross-linking reactions through polymerization are effective from the standpoints of the absence of adverse effects upon electrophotographic characteristics and simplicity of preparation (e.g., the reaction is fast, the reaction proceeds stoichiometrically, and contamination with impurities is minimal because no auxiliary agent is used for accelerating the reaction).

The resin of the present invention can be prepared by polymerizing a monomer containing polymerization reactive groups having preferably two or more of polymerizing functional groups, together with a monomer containing functional group(s) capable of producing hydroxyl group(s) through decomposition; or by copolymerizing a monomer containing two or more polymerizing functional groups and a monomer containing hydroxyl group(s), and then protecting the hydroxyl group(s) in a manner as described above.

Specific examples of polymerizing functional groups include $CH_2{=}CH{-}$, $CH_2{=}CH{-}CH_2{-}$, $CH_2{=}CH{-}COO{-}$, $CH_2{=}C(CH_3){-}COO{-}$, $CH_3CH{=}CH{-}COO{-}$, $CH_2{=}CH{-}CONH{-}$, $CH_2{=}C(CH_3){-}CONH{-}$, $CH_3CH{=}CH{-}CONH{-}$, $CH_2{=}CH{-}OCO{-}$, $CH_2{=}C(CH_3){-}OCO{-}$, $CH_2{=}CH{-}CH_2{-}OCO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, $CH_2{=}CH{-}S{-}$, etc.

The two or more polymerizing functional groups contained in the above-described monomers may be either the same or different selected from the above-cited groups to form polymers insoluble in nonaqueous solvents through polymerization.

Specific examples of monomers containing two or more of polymerizing functional groups of the same kind include styrene derivatives such as divinylbenzene, trivinylbenzene, etc.; methacrylic acrylic or crotonic acid esters, vinyl ethers or ally ethers of polyhydric alcohols (e.g., ethylene glycol, diethylene glycol, triethylene glycol, polyethylene glycol #200, #400, #600, 1,3-butylene glycol, neopentyl glycol, dipropylene glycol, polypropylene glycol, trimethylolpropane, trimethylolethane, pentaerythritol) or polyhydroxyphenols (e.g., hydroquinone, resorcine, catechol and their derivatives); vinyl esters, ally esters, vinyl amides or allyl amides of dibasic acids (e.g., malonic acid, succinic acid, glutaric acid, adipic acid, pimelic acid, maleic acid, phthalic acid, itaconic acid); condensates of polyamines (e.g., ethylenediamine, 1,3-propylenediamine, 1,4-butylenediamine) and carboxylic acids containing a vinyl group (e.g., methacrylic acid, acrylic acid, crotonic acid, allylacetic acid); etc.

Specific examples of monomers containing two or more different kinds of polymerizing functional groups include vinyl group-containing ester or amide derivatives of vinyl group-containing carboxylic acids (e.g., methacrylic acid, acrylic acid, methacryloylacetic acid, acryloylacetic acid, methacryloylpropionic acid, acryloylpropionic acid, itaconyloylacetaic acid, itaconyloypropionic acid, reaction products of carboxylic acid anhydrides and alcohols or amines (such as allyloxycarbonylpropionic acid, allyoxycarbonylacetic acid, 2-allyloxycarbonylbenzoic acid, allylaminocarbonylpropionic acid)), with specific examples including vinylmethacrylate, vinylacrylate, vinylitaconate, allylmethacrylate, allylacrylate, allylitaconate, vinylmethacryloylacetate, vinylmethacryloylpropionate, allylmethacryloylpropionate, vinyloxycarbonylmethylmethacrylate, vinyloxycarbonylmethyloxycarbonylethylene acrylate, N-allylacrylamide, N-allylitaconic acid amide, methacryloylpropionic acid allyl amide, and so on; and condensates of aminoalcohols (e.g., aminoethanol, 1-aminopropanol, 1-aminobutanol, 1-aminohexanol, 2-aminobutanol) and vinyl-containing carboxylic acids.

The resins of the present invention are formed through polymerization using the above-described monomers containing two or more of polymerizing functional groups in a proportion of about 0.1 to about 10% by weight, preferably 0.5 to 5% by weight, based on the total monomers.

On the other hand, resins containing cross-linking functional groups capable of undergoing a curing reaction by heat and/or light together with the foregoing hydroxyl group-producing functional groups can be used as resin binder in the present invention, and a cross-linking structure may be formed therein at the subsequent stage of producing a plate precursor.

The above-described cross-linking functional group may be any of those capable of forming a chemical bond by undergoing a chemical reaction between molecules. More specifically, a usable mode of the chemical reaction involves causing the intermolecular bonding through a condensation reaction, addition reaction or so on, or the cross-linking through polymerization by application of heat and/or light. Specific examples of such functional groups include those containing at least one combination of a dissociable hydrogen-containing functional group (e.g., —COOH, —$PO_3H_2$,

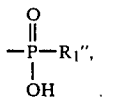

wherein $R_1''$ represents the same hydrocarbon residue as described in regard to $R_1$ to $R_3$ in the foregoing formula (I), or —$OR_1'''$ (wherein $R_1'''$ has the same meaning as $R_1''$), —OH, —SH, —$NHR_2''$ (wherein $R_2''$ represents a hydrogen atom, or an alkyl group containing 1 to 4 carbon atoms, e.g., methyl, ethyl, propyl, butyl, etc.) and a functional group selected from among

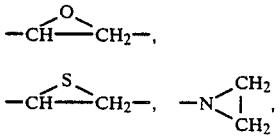

—NCO, —NCS and cyclic dicarboxylic acid anhydrides; —$CONHCH_2OR_3''$ (wherein $R_3''$ represents a hydrogen atom or an alkyl group containing 1 to 6 carbon atoms, e.g., methyl, ethyl, propyl, butyl, hexyl, etc.); and polymerizing double bond-containing groups.

Specific examples of polymerizing double bond-containing groups include those cited as specific examples of the foregoing polymerizing functional groups.

In addition, other functional groups and compounds can be used as cited in Goh Endo, *Netsukokasei Kobunshi no Seimitsuka*, C.M.C. K.K. (1986), Yuji Harasaki, *Saishin Binder Gijutsu Binran*, chap. II-1, Sogo Gijutsu Center (1985), Takayuki Otsu, *Acryl Jushi no Gosei Sekkei to Shin-Yoto Kaihatsu*, Chubu Keiei Kaihatsu Center Shuppanbu (1985), Eizo Ohmori, *Kinosei Akuriru-kei Jushi*, Techno System (1985), Hideo Inui & Gentaro Nagamatsu, Kenkosei Kobunshi, Kodansha (1977), Takahiro Tsunoda, *Shin-Kankosei Jushi*, Insatsu Gakkai Shuppanbu (1981), G.E. Green & B.P. Star, *J. Macro. Sci. Revs. Macro. Chem.*, C21(2), pp. 187-273 (1981-82), C.G. Roffey, *Photopolymerization of Surface Coatings*, A. Wiley Interscience Pub. (1982), and so on.

These cross-linking functional groups and hydroxyl group-producing functional groups may be contained together in the same copolymer constituent, or separately in different copolymer constituents.

Monomers which correspond to copolymer constituents containing cross-linking functional groups as described above may be e.g., any of the vinyl compounds containing functional groups which are copolymerizable with the groups of the foregoing general formula (II).

Such vinyl compounds are described, e.g., in KobunshiGakkai (High Molecular Society) (edtor), *Kobunshi (High Molecular) Data Handbook (Kiso-hen (Basic Volume))*, Baihukan (1986). Specific examples ,of these vinyl compounds include acrylic acid, α- and/or β-substituted acrylic acids (e.g., α-acetoxyacrylic acid, α-acetoxymethylacrylic acid, α-(2-aminomethylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acids (e.g., 2-pentenic acid, 2-methyl-2-hexenic acid, 2-octenic acid), maleic acid, maleic acid half esters, maleic acid half amide, vinylbenzenecarboxylic acid, vinylsulfonic acid, vinylphosphonic acid, vinyl or allyl half ester derivatives of dicarboxylic acids, and ester or amide derivatives of these carboxylic or sulfonic acids containing the foregoing cross-linking functional groups in their substituents.

A preferred fraction of "the cross-linking functional group-containing copolymer constituent" in the resin of this invention ranges preferably from 1 to 80 wt%, and particularly from 5 to 50 wt%.

To these resins, a reaction accelerator may be added, if desired, for accelerating the cross-linking reaction. Examples of accelerators for the cross-linking reaction include acetic acid, propionic acid, butyric acid, benzenesulfonic acid, p-toluenesulfonic acid, peroxides, azobis compounds, cross-linking agents, sensitizers, photopolymerizing monomers, etc. For example, the compounds described in Shinzo Yamashita & Tosuke Kaneko. *KakVozai (Cross-Linking Agents) Handbook*, Taiseisha (1981) can be employed as cross-linking agents. More specifically, cross-linking agents such as organic silanes, polyurethanes, polyisocyanates and so on, and curing agents such as epoxy resins, melamine resin and so on can be employed.

In the case of light cross-linkable functional groups, compounds cited as examples in the foregoing publications concerning light-sensitive resins can be used.

When the resins containing cross-linking functional groups are used, the cross-linking in at least part of polymers can be carried out in the process of forming a photoconductive layer, or upon heating and/or optical exposure prior to etching. Usually, a heat curing processing is preferred, and effected by strictly controlling the drying condition for production of conventional photoreceptors. For instance, the heat curing may be carried out at 60° to 120° C. for 5 to 120 minutes. When the curing processing is carried out in the presence of the above-described reaction accelerators, more gentle conditions can be employed.

Also, conventional resins can be used together with the resins of the present invention. Examples of those conventional resins include silicone resins, alkyd resins, vinyl acetate resins, polyester resins, styrenebutadiene resins, acryl resins, etc., and more specifically, known materials as cited e.g., in Ryuji Kurita & Jiro Ishiwatari, *Kobunshi*, Vol. 17, p. 278 (1968), Harumi Miyamoto & Hidehiko Takei, *Imaging*, No. 8, p. 9 (1973).

The resins of the present invention and conventional resins can be blended in an arbitrary ratio, provided that the content of hydroxyl group-producing functional group containing component in the total amount of the resins ranges from 0 5 to 95 wt%, particularly from 1 to 85 wt%, and more preferably from 30 to 85 wt%.

Since hydroxyl groups are converted to protected functional groups in the resins of the present invention, interaction with zinc oxide particles is minimized. In addition, the hydroxyl groups, or hydrophilic groups, produced by an oil-desensitizing treatment further enhance the affinity of the non-image part for water.

Moreover, in the plate precursor, though they become a soluble in water by release of hydroxyl groups in the oil-desensitizing treatment, the resins of the present invention prevent elution in the non-image part due to the presence of a cross-linking structure in at least part of the polymer, while sufficient affinity for water is retained.

Accordingly, the affinity of the non-image part for water is further enhanced by the hydroxyl groups produced in the resin, and the durability of the plate is also improved.

The effect of enhancing the affinity for water can be maintained as usual even when the proportion of hydroxyl group-producing functional group-containing resins to whole binder resins is reduced. A large number of clear prints free from background stains can be obtained even when a large-sized printing machine is used, or printing conditions including fluctuation of printing pressure are severe.

In the lithographic printing plate precursor of this invention, all the above-described resin binders are used in an amount of from 10 to 60 parts by weight, preferably 15 to 40 parts by weight, per 100 parts by weight of photoconductive zinc oxide.

In this invention, various kinds of dyes can be used together with the photoconductive zinc oxide as spectral sensitizers, if desired. Specific examples of such spectral sensitizers are carbonium type dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes) and metal free- or metallo-phthalo cyanine dyes, as described, for example, in Harumi Miyamoto & Hidehiko Takei, *Imaging*, No. 8, p. 12 (1973), C.J. Young, et al, *RCA Review*, Vol. 15, p. 469 (1954), Kohei Kiyota, *Denkitsushin Gakkai Ronbun Shi* (*Journal of Telecommunication Society*), *J 63-C*, No. 2, p. 97 (1980), Yuji Harasaki, *Kogyo Kagaku Zasshi* (*Journal of Industrial Chemistry*), Vol. 66, p. 78 and p. 188 (1963), Tadaaki Tani, *Nihon Shashin Gakkai Shi* (*Journal of The Society of Photographic Science and Technology of Japan*), Vol. 35, p. 208 (1972).

More specifically, dyes of carbonium type, triphenylmethane type, xanthene type and phthalein type, which are also used as spectral sensitizers are disclosed in JP-B-51-452, JP-A-50-90334, JP-A-50-114227, JP-A-53-39130, JP-A-53 82353, U.S. Pat. No. 3,052,540, U.S. Pat. No. 4,054,450, JP-A-57-16456, and so on.

Polymethine dyes including oxonol dyes, merocyanine dyes, cyanine dyes, rhodacyanine dyes and the like, for use in the present invention, are described in F.M. Harmmer, *The Cyanine Dyes and Related Compounds*. More specifically, such dyes include those disclosed in U.S. Pat. Nos. 3,047,384, 3,110,591, 3,121,008, 3,125,447, 3,128,179, 3,132,942 and 3,622,317, British Patents 1,226,892, 1,309,274 and 1,405,898, JP-B-48-7814, JP-B-55-18892, etc.

Moreover, specific examples of polymethine dyes spectrally sensitizing the near infrared to infrared regions of wavelengths longer than 700 nm are disclosed in JP-A-47-840, JP-A-47-44180, JP-B-51-41061, JP-A-49-5034, JP-A-49-45122, JP-A-57-46245, JP-B-56-35141, JP-A-57-157254, JP-A-61-26044, JP-A-61-27551, U.S. Pat. Nos. 3,619,154 and 4,175,956, *Research Disclosure*, No. 216 pp. 117–118 (1982). The photoreceptor of this invention is superior in the respect that the combined use of various sensitizing dyes causes little fluctuation in electrophotographic properties (initial voltage, dark decay, light-sensitivity) and little fluctuation due to environmental conditions, in particular, moisture.

In addition, various known additives for electrophotographic photoreceptive layers, such as chemical sensitizers, etc., can be used, if needed. Examples of such additives include electron accepting compounds (e.g., halogens, benzoquinones, chloranil, acid anhydrides, organic carboxylic acids) as described in *Imaging*, No. 8, p. 12 (1973), and polyarylalkane compounds, hindered phenol compounds and p-phenylenediamine compounds as described in Hiroshi Komon, *Saikin no Kodendo Zairyo to Kankotai no Kaihatsu Jitsuyoka* (Recent Development and Practical Use of Photoconductive Materials and Photoreceptors), chaps. 4–6, Nippon Kagaku Joho K.K. Shuppanbu (1986).

There is no particular restriction on the addition amounts of these additives, but they are usually added in amounts ranging from 0.0001 to 2.0 parts by weight per 100 parts by weight of the photoconductive material used.

A preferred thickness of the photoconductive layer is from 1 to 100 microns, particularly from 10 to 50 microns.

When the photoconductive layer is used as a charge generating layer for an integrated type photoreceptor which comprises a charge generating layer and a charge transporting layer in combination, a thickness of the charge generating layer is preferably from 0 01 to 1 micron, particularly from 0.05 to 0.5 micron.

The photoconductive layer of this invention can be formed on a support of conventional use in the art. In general, the support for the electrophotographic photoreceptive layer is preferably electrically conductive. Conductive supports which can be used in the present invention include the same ones as used in conventional photoreceptors, e.g., metals, base materials (such as paper and plastic sheets) to which electric conductivity is imparted by impregnation with a low resistance material, base materials the back surface (or the surface opposite to what has thereon a photoreceptive layer) of which is rendered conductive and further coated with at least one layer for the purpose of prevention of curling, the aforesaid supports which further have a waterproofing adhesive layer on the surface thereof, the aforesaid supports which further have one or more (if desired) pre-coats, papers laminated with an Al-evaporated conductive plastic film or the like, etc.

More specifically, conductive materials for use in the present invention are described in Yukio Sakamoto, *Denshi Shashin* (*Electrophotography*), Vol. 14, No. 1, pp. 2–11 (1975), Hiroyuki Moriga, *Nyumon Tokushushi no Kagaku* (*Introduction to Chemistry of Specific Papers*), Kobunshi Kanko Kai (1975), M.F. Hoover, *J. Macromol Sci Chem.*, A-4 (6), pp. 1327–1417 (1970), etc.

The production of a printing plate from the lithographic printing plate precursor of the present invention can be carried out by a conventional procedure. The solution which can be used for the oil-desensitization treatment are well known in the art as described in, for example, JP-B-47-32681, JP-B-55-9315, JP-B-46-21244, JP-B 46-7106, JP-A-52-502, JP-B 45-24609, JP-A-57-2796, JP-A-57-20394, JP-A 53-83807, JP-A-53-109701, JP A-52-126302, JP-B-40-763, JP-B-47-29642, JP-B-43-28404, JP-A-51-118501, etc.

More specifically, the oil-desensitizing solution is an aqueous solution comprising an agent which renders the non-image are hydrophilic as a main component, and other various additives such as a pH-adjusting agent, a buffering agent, etc. The hydrophilicity-providing agent can be any of conventionally known agents used for this purpose, for example, ferrocyanides and phosphates, phytic acid salts, aqueous polymers having a chelating ability, metal complexes, etc. The pH-adjusting agents and buffering agents can be any of known inorganic acids, organic acids or salts thereof, alone or as a mixture thereof. Examples of such agents include formic acid, acetic acid, butyric acid, valeric acid, lactic acid, tartaric acid, propionic acid, oxalic acid, malonic acid, succinic acid, glutaric acid, maleic acid, phthalic acid, citraconic acid, itaconic acid, fumaric acid, tricarboxylic acid, glycolic acid, thioglycolic acid, malic acid, citric acid, gluconic acid, pilvic acid, glycollic acid, salicylic acid, adipic acid, hydroacrylic acid, glyceric acid, p-toluenesulfonic acid and their metal salts and organic amine salts.

Further, when the main agent of the oil-desensitizing solution is a ferrocyanide, a chelating agent such as EDTA-2Na or a reducing agent such as a sulfite can be preferably added to the oil-desensitizing solution in order to retain an ability to render hydrophilic and also to prevent precipitation.

Also, when the main agent of the oil-desensitizing solution is a phytic acid salt, it is preferred to add a water-soluble cationic polymer as described in JP-A-60-23099 and a lower molecular weight electrolyte to the solution in order to decrease the generation of stains.

In addition, a wetting agent or dampening agent can also be incorporated into the oil-desensitizing solution, and examples of such agents include ethylene glycol, diethylene glycol, triethylene glycol, polyethylene glycol, glycerin, gum arabic, carboxymethyl cellulose, acrylic polymers, benzyl alcohol, cyclohexyl alcohol, propargyl alcohol, methanol, ethanol, iso- and n-propyl alcohols, triethanolamine, etc.

Further, preservatives such as salicylic acid, phenol, phenol butyl p-benzoate, sodium dehydroacetate, 4-isothiazolon-3-one, and the like can be added to the oil-desensitizing solution.

Furthermore, anti-rusting agents such as sodium nitrite, dicyclohexylammonium nitrite, etc. can be added to the oil-desensitizing solution.

In the oil-desensitizing treatment used in the present invention, an additional treatment for rendering the resin binder of the present invention hydrophilic may be conducted before or after the treatment with the above oil-desensitizing solution. The above additional treatment can be effected with an aqueous acidic solution or an aqueous alkaline solution.

The aqueous acidic solution comprises the inorganic or organic acid or the salt thereof, alone or as a mixture thereof, as described for the oil-desensitizing solution, and the aqueous alkaline solution comprises an inorganic compound such as sodium hydroxide, ammonia, sodium bicarbonate, sodium carbonate, sodium sulfite, sodium bisulfite, ammonium bisulfite, etc. or an organic basic compound such as trimethylamine, pyridine, piperidine, morpholine, ethanolamine, triethanolamine, hydrazine, etc., alone or as a mixture thereof.

Either the above-described aqueous acidic or alkaline solution may contain a water-soluble organic solvent such as the alcohols as described above for the wetting agents or dampening agents, ketones such as acetone, methyl ethyl ketone, etc., ethers such as tetrahydrofuran, dioxane, trioxane, etc. Further, the solution may contain other additives as described for the oil-desensitizing solution.

The acidic compounds or basic compounds as main agents used for the treatment for rendering the resin binder hydrophilic are preferably contained in an amount of from about 0.1 to about 1 mol per liter of the treating solution. If the organic solvent in incorporated into the treating solution, it is preferably used in a proportion of about 5 to about 50% by volume based on the total volume of the treating solution.

The oil-desensitizing treatment can be carried out at a temperature of about 10° C. to about 50° C., preferably from 20° C. to 35° C., for a period of not longer than about 5 minutes. Upon subjecting the oil-desensitizing treatment, the hydroxy group-producing functional groups are converted into hydroxy groups by hydrolysis or hydrogenolysis.

This invention is illustrated in greater detail by reference to the following examples. However, the invention is not limited to these examples.

EXAMPLE 1 AND COMPARATIVE EXAMPLES A, B AND C

After heating a mixture of 60 g of benzylmethacrylate, 40 g of the monomer corresponding to the foregoing compound (2), 2 g of divinylbenzene and 300 g of toluene to 75° C. in a nitrogen gas stream, 1.0 g of 2,2'-azobisisobutylonitrile (AIBN) were added to the mixture. The resulting mixture underwent reaction for 8 hours to produce a copolymer. The copolymer thus obtained, named (1), had a weight average molecular weight of 100,000. A mixture of 40 g (on a solids basis) of the copolymer (1), 200 g of zinc oxide, 0.05 g of Rose Bengale, 0.01 g of phthalic anhydride and 300 g of toluene were dispersed in a ball mill for 2 hours to prepare a photoreceptive layer-forming composition. The composition was coated on a sheet of paper, which had received a conductive treatment, at a dry coverage of 25 g/m2 using a wire bar. The coated paper was dried at 110° C. for 1 minute, and allowed to stand for 24 hours in the dark at 20° C. and 65% RH. An electrophotographic photoreceptor was thus produced.

Photoreceptors A, B and C were prepared for comparison in the same manner as described above, except the following receptive compositions were used in the place of the photoreceptive layer-forming composition.

Photoreceptor A for Comparison:

Photoreceptor A was produced in the same manner as the above-described photoreceptor of the present invention, except that copolymer (1) was replaced by the copolymer (A). Copolymer (A) was prepared in the same manner as the copolymer (1), except that polymerization was carried out in the absence of divinylbenzene, the reaction temperature was changed to 60° C. from 75° C., and the amount of AIBN added was decreased to 0.5 g from 1.0 g. Copolymer (A) had a weight average molecular weight of 90,000.

Photoreceptor B for Comparison:

Photoreceptor B was produced in the same manner as the above-described photoreceptor of the present invention, except benzylmethacrylate/2-hydroxymethacrylate (8/2 by weight) copolymer having a weight average molecular weight of 95,000 was used in the place of said copolymer (1).

Photoreceptor C for Comparison:

The photoreceptor C was produced in the same manner as the above-described photoreceptor of the present invention, except butylmethacrylate/acrylic acid (98/2 by weight) copolymer having a weight average molecular weight of 45,000 was used as a binder resin of the photoconductive layer in the place of the copolymer (1).

These photoreceptors were examined for the filmsurface property (smoothness of the surface), the electrostatic characteristics, the oil-desensitivity of the photoconductive layer (expressed in terms of the contact angle of the oil-desenstized photoconductive layer with water), and the printing property (including background stains and printing durability). The printing property was determined as follows: Each photoreceptor was exposed and developed using an automatic camera processor ELP 404V (trade name, products of Fuji Photo Film Co., Ltd.) and a developer ELP-T (trade name, products of Fuji Photo Film Co., Ltd.) to form images, and etched with an etching processor using an oil-desensitizing solution ELP-E (trade name, products of Fuji Photo Film Co., Ltd.), resulting in conversion to a lithographic printing plate. The thus obtained printing plate was examined for the printing property (using Hamada Star Type 800 SX (trade name, products of Hamada Star K.K.) as the printing machine). The results obtained are shown in Table 1.

TABLE 1

| | Invention | Comparative | | |
|---|---|---|---|---|
| | Example 1 | Example A | Example B | Example C |
| Smoothness of Photoconductive layer (*1) (sec/cc) | 85 | 85 | 80 | 70 |
| Electrostatic characteristics (*2) $V_o$(V) | 560 | 550 | 540 | 500 |
| $E_{1/10}$ (lux.sec) | 8.5 | 8.5 | 8.0 | 9.0 |
| Contact Angle with water *3) (degree) | below 5 | below 5 | 18 | 15–28 (widely varied) |
| Property of Reproduced Image *4) | | | | |
| I: Ordinary temperature and humidity | A | A | A | B |
| II: High temperature and humidity | A | A | C | D |
| Background Stain of Prints (*5) | | | | |
| I: | A | A | A | B |
| II: | More than 10,000 prints free from background stain | Background stain is generated from the 7000th print | Background stain is generated from the 6000th to 7000th print | Background stain is generated from the 1st print |

The parameters shown in Table 1 were evaluated as follows.

(*1) Smoothness of Photoconductive Layer:

The smoothness (sec/cc) of each photoreceptor was measured with a Beck smoothness tester (made by Kumagaya Riko K.K.) under a condition of air volume of 1 cc.

(*2) Electrostatic Characteristics:

After applying a corona discharge of −6 KV onto the surface of each photoreceptor for 20 seconds using a paper analyzer (Paper Analyzer type SP-428, trade name, made by Kawaguchi Denki K.K.) in a dark room at 20° C. and 5% RH, the photoreceptor was allowed to stand for 10 seconds, and then the surface potential ($V_o$) was measured. Subsequently, the surface of the photoconductive layer was exposed to visible light of 2:0 lux, and the time required for the surface potential to be reduced to 1/10 its starting value ($V_o$) was measured, and the exposure $E_{1/10}$ (lux·sec) was thus determined.

(*3) Contact Angle with Water:

After oil-desensitizing the surface of each photoconductive layer by passing each photoconductor once through an etching processor using an oil-desensitizing solution ELP-E (trade name, products of Fuji Photo Film Co., Ltd.), a distilled water drop of 2 micro-liters was placed on the oil-desensitized surface, and the contact angle formed by the water drop was measured with a goniometer.

(*4) Property of Reproduced Image:

After allowing each photoreceptor and an automatic camera processor ELP 404V (trade name, products of Fuji Photo Film Co., Ltd.) to stand for one day and night at room temperature and humidity (20° C., 65% RH), the photoreceptor was processed with the aforesaid automatic camera processor to form a reproduced image. The reproduced image on the printing plate precursor was observed with the naked eye to evaluate the fog and image quality which is defined as the property I. The property II was evaluated in the same manner as the property I, except that the process was carried out under at a higher temperature and humidity of 30° C. and 80% RH.

(*5) Background Stain of Prints:

Each photoreceptor was processed with an automatic camera processor ELP 404V (trade name, products of Fuji Photo Film Co., Ltd.) to form a toner image thereon, and then oil-desensitized under the same condition as in the case of the foregoing (*3). The thus obtained printing plate was installed as an offset master in an offset printing machine (Hamada Star Type 800SX, made by Hamada Star K.K.), and therewith were printed 500 sheets of wood free paper. Thus, background stains on all the prints was evaluated by the naked eye. This evaluation is defined as background stain I.

The background stain II was evaluated in the same manner as the background stain I, except the oil-desensitizing solution was diluted five times, the dampening solution used at the time of printing was diluted two times, and the printing pressure of the printing machine was increased. That is, the platemaking and printing conditions in the case of the background stain II were more severe than those in the case of the background stain I. Up to 10,000 prints were made in order to evaluate the background stain II property.

The ranks used for evaluating the property of reproduced image and background stain of prints are as follows:

Image Quality

A: Clear image without background stains

B: Slight background stains

C: Fair amount of background stains and deficiency in fine lines of the reproduced letters D: Remarkable background stains, decreased density in the image area, and apparent deficiency in the reproduced letters Background Stains of Prints A: No stains B: Slight spot-like stains As can be seen from Table 1, the reproduced images obtained by using the photoreceptor of the present invention, comparative photoreceptor A and comparative photoreceptor B were all clear, while those obtained from comparative photoreceptor C were unclear because of considerable deterioration of the smoothness of the photoconductive layer surface and generation of fog in the non-image part.

When each photoreceptor was processed under conditions of 30° C. and 80% RH, the reproduced images obtained in the comparative examples B and C were of low quality (background fog, and image densities of below 0.6).

As for the contact angle of the oil-desensitized photoreceptor with water, those in the invention and comparative example B were less than 15°, thus indicating that the surface of the non-image part was rendered sufficiently hydrophilic only in the invention and the comparative example B.

Further, when printing was practiced using the processed photoreceptors as a master plate for offset printing, only the plates produced in the invention and comparative example A exhibited no background stain in the non-image part. Furthermore, when printing was continued using both plates under severe conditions, including higher printing pressure, the 10000th print obtained using the plate of the invention had good image quality and no background stain, while the plate of comparative example A caused background stain of the 7000th print. On the other hand, the plate of the comparative example C caused background stain even in the first print.

In conclusion, only the photoreceptor of the present invention was able to always reproduce clear images even when processed at higher temperature and humidity to provide not less than 10,000 sheets of background stain-free prints.

EXAMPLES 2 TO 13

Electrophotographic photoreceptors were prepared in the same manner as in Example 1, except each cf the copolymers set forth in Table 2 were used in the place of the copolymer [1] as the binder resin, of the present invention.

TABLE 2

| Example | Resin | Monomers corresponding to constitutional repeating units of the copolymer of this invention* | | |
|---|---|---|---|---|
| 2 | (II) | $CH_2=C(CH_3)COOC_2H_5$ | $CH_2=C(CH_3)COO(CH_2)_2OSi(CH_3)_2C_4H_9$ | $CH_2=C(CH_3)COO(CH_2)_2OCOC(CH_3)=CH_2$ |
| 3 | (III) | " | $CH_2=C(OCOCH_2CF_3)COOCH_2CHCH_2OCOCH_2CF_3$ | $CH_2=C(CH_3)COOCH_2CH=CH_2$ |
| 4 | (IV) | $CH_2=C(CH_3)COOC_4H_9$ | $CH_2=C(CH_3)CONH(CH_2)_2O-Si(C_3H_7)_3$ | $CH_2=C(CH_3)COO(CH_2)_2COO-CH=CH_2$ |

TABLE 2-continued

| Example | Resin | Monomers corresponding to constitutional repeating units of the copolymer of this invention* | | |
|---|---|---|---|---|
| 5 | (V) | 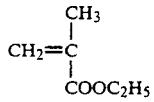 | 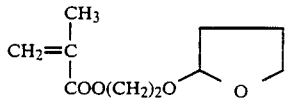 | 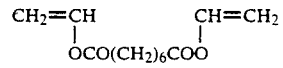 |
| 6 | (VI) | " | 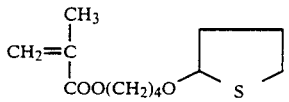 | 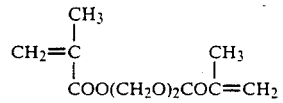 |
| 7 | (VII) | 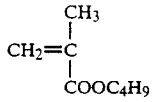 | 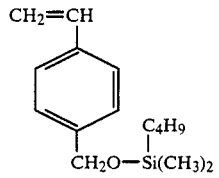 | 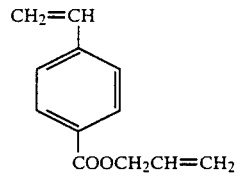 |
| 8 | (VIII) | 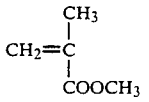 | 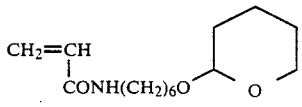 | 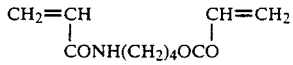 |
| 9 | (VIX) | 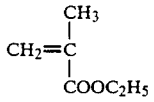 | 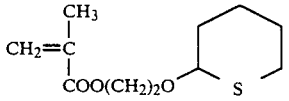 | 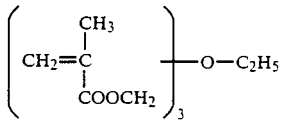 |
| 10 | (X) | 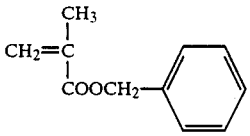 | 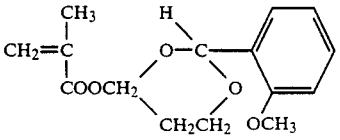 | 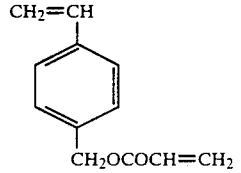 |
| 11 | (XI) | 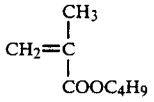 | 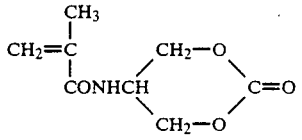 | 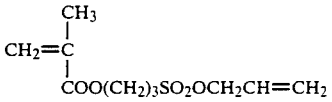 |
| 12 | (XII) | 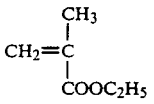 | 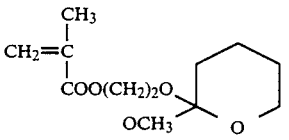 | 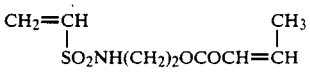 |
| 13 | (XIII) | " | 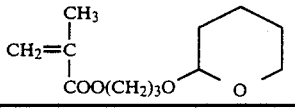 | 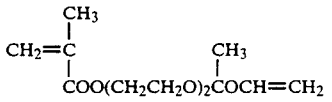 |

*The proportion of the monomers in each of Examples 2 to 13 is 58:40:2 (wt %), respectively The weight average molecular weight of each copolymer was within the range of $3\times10^4$ to $9\times10^4$.

These electrophotographic photoreceptors were processed using the same apparatus as in Example 1. All of the master plates thus obtained for offset printing had a density of 1.0 or above, and all the images reproduced thereon were clear. After etching processing, each of the thus obtained printing plates was used to make more than 10,000 sheets of prints in a printing machine. Even after the printing operation was repeated 10,000 times, prints with clear, fog-free images were obtained.

On the other hand, the foregoing photoreceptors were allowed to stand at 45° C. and 75% RH for 2 weeks, and then processed in the same manner as described above. Under these circumstances, the same results as in the case where the photoreceptors were not subjected to any aging processing were obtained.

EXAMPLE 14

After a mixture of 67 g of benzylmethacrylate, 25 g of the monomer corresponding to the compound (21), 8 g of N-methoxymethylmethacrylamide and 200 g of toluene was heated to 75° C. in a stream of nitrogen, 2 g of AIBN was added thereto. The resulting mixture underwent reaction for 8 hours. Thereafter, it was heated up to 100° C., and the reaction was further continued for 2 hours. The copolymer thus obtained had a weight average molecular weight of 98,000.

An electrophotographic photoreceptor was prepared in the same manner as in Example 1, except this copolymer, designated (XIV) was used in the place of copolymer (1).

This photoreceptor was processed using the same automatic camera processor ELP 404V as in Example 1 The obtained master plate for offset printing had a density of 1.0 or above, and the image reproduced thereon was clear. After etching processing, the thus obtained printing plate was used to make prints in a printing machine. Even after the printing operation was repeated 10,000 times, prints with clear image and no fog in the non-image part were obtained.

EXAMPLE 15 AND COMPARATIVE EXAMPLES D, E AND F.

After heating a mixture of 30 g of benzylmethacrylate, 40 g of the monomer corresponding to the foregoing compound (2), 30 g of allylmethacrylate and 400 g of toluene to 60° C in a stream of nitrogen 1.0 g of 2,2'-azobis(2,4-dimethylvaleronitrile) was added to the mixture. The resulting mixture underwent reaction for 8 hours to produce a copolymer. The thus obtained copolymer (XV) had a weight average molecular weight of 40,000. A mixture of 30 g (on a solids basis) of the copolymer (XV), 10 g of butylmethacrylate/acrylic acid (98/2 by weight) copolymer (weight average molecular weight: 45,000), 200 g of zinc oxide, 0.05 g of Rose Bengale, 0 01 g of phthalic anhydride and 300 g of toluene were dispersed in a ball mill for 2 hours. To the dispersion was prepared, 10 g of allylmethacrylate and 0.5 g of 2,2'-azobis(2,4-dimethylvaleronitrile were added, and further dispersed in the ball mill for 10 minutes to prepare a photoreceptive layer-forming composition. The composition was coated on a sheet of paper, which had received a conductive treatment, at a dry coverage of 25 g/m$^2$ using a wire bar. The coated paper was dried at 100° C. for 60 minutes, and allowed to stand for 24 hours in the dark at 20° C. and 65% RH to obtain an electrophotographic photoreceptor.

Photoreceptors D, E and F were prepared for comparison in the same manner as described above, except the following compositions were used in the place of the photoreceptive layer-forming composition, respectively.

Photoreceptor D for Comparison:

After heating a mixture of 60 g of benzylmethacrylate, 40 g of the monomer corresponding to the foregoing compound example (2) and 200 g of toluene to 70° C. in a stream of nitrogen, 1.0 g of 2,2'-azobisisobutyronitrile was added to the mixture. The resulting mixture underwent reaction for 8 hours to produce a copolymer having a weight average molecular weight of 45,000.

Subsequently, 30 g (on a solids basis) of the foregoing copolymer (D), 10 g of butylmethacrylate/acrylic acid (98/2 by weight) copolymer (weight average molecular weight: 45,000), 200 g of zinc oxide, 0.05 g of Rose Bengale, 0.01 g of phthalic anhydride and 300 g of toluene were mixed and dispersed in a ball mill for 2 hours to prepare a photoreceptive layer-forming composition. The composition was coated on a sheet of paper, which had received a conductive treatment, at a dry coverage of 25 g/m$^2$ using a wire bar. The coated paper was dried at 110° C. for 1 minute, and allowed to stand for 24 hours in the dark under the condition of 20° C. and 65% RH. Electrophotographic photoreceptor D was thus obtained.

Photoreceptor E for Comparison:

The copolymer (E) having a weight average molecular weight of 42,000 was prepared under the same reaction condition as the copolymer (D), except a mixture of 85 g of benzylmethacrylate, 15 g of 2-hydroxyethylmethacrylate and 200 g of toluene was used in the place of the foregoing mixture.

Subsequently, the electrophotographic photoreceptor E was prepared in the same manner as in the comparative example D, except the foregoing copolymer (E) was used in the place of the copolymer (D) used in the comparative example D.

Photoreceptor F for Comparison:

The photoreceptor F was produced in the same manner as in the comparative example D, except 40 g of butylmethacrylate/acrylic acid (98/2 by weight) copolymer (weight average molecular weight 45,000) was used as a binder resin of the photoconductive layer.

These photoreceptors were examined for the filmsurface property (smoothness of the surface), the electrostatic characteristics, the oil-desensitivity of the photoconductive layer (expressed in terms of the contact angle of the oil-desensitized photoconductive layer with water), and the printing property. The printing property was determined as follows: Each photoreceptor was exposed and developed using an automatic camera processor ELP 404V (trade name, products of Fuji Photo Film Co., Ltd.) and a developer ELP-T (trade name, products of Fuji Photo Film Co., Ltd.) to form images, and etched with an etching processor using an oil-desensitizing solution ELP-E to result in conversion to a lithographic printing plate. The thus obtained printing plates were used for examination of the printing property. A Hamada Star Type 800SX (trade name, products of Hamada Star K.K.) was used as the printing machine.

The results obtained are shown in Table 3.

TABLE 1

| | Invention | Comparative | | |
|---|---|---|---|---|
| | Example 15 | Example D | Example E | Example F |
| Smoothness of Photoconductive layer (*1) (sec/cc) | 85 | 85 | 80 | 70 |
| Electrostatic characteristics (*2) $V_o$(V) | 545 | 550 | 540 | 500 |

TABLE 1-continued

| | Invention | Comparative | | |
|---|---|---|---|---|
| | Example 15 | Example D | Example E | Example F |
| $E_{1/10}$ (lux.sec) | 8.5 | 8.5 | 8.0 | 9.0 |
| Contact Angle with Water *3) (degree) | below 5 | below 5 | 18 | 15–28 (widely varied) |
| Property of Reproduced Image *4) | | | | |
| I: Ordinary temperature and humidity | A | A | A | B |
| II: High temperature and humidity | A | A | C | D |
| Background Stain of Prints (*5) | | | | |
| I: | A | A | A | B |
| II: | More than 10,000 prints free from background stain | Background stain is generated from the 7000th print | Background stain is generated from the 6000th to 7000th print | Background stain is generated from the 1st print |

The terms shown in Table 3 were evaluated in accordance with the same embodiments as in Table 1.

As can be seen from the data shown in Table 3, the reproduced images obtained by using the photoreceptor of this invention, the comparative photoreceptor E and the comparative photoreceptor D were all clear, while those obtained from the comparative photoreceptor E were unclear. This was due to deterioration of the smoothness of the photoconductive layer surface and generation of considerable fog in the non-image part.

When each photoreceptor was processed under conditions 30° C. and 80%RH the reproduced images obtained in the comparative examples E and F were of low quality (background fog, and image densities of below 0.6).

As for the contact angle of the oil-desensitized photoreceptor with water, those of the present invention and the comparative example E were less than 15°, which indicated that the surface of the non-image part was rendered sufficiently hydrophilic only in this example and the comparative example E.

Further, when printing was practiced using the processed photoreceptors as master plate for offset printing, only the plates produced in this example and the comparative example D caused no background stain in the non-image part. Furthermore, when printing was continued using both plates under the more severe set of conditions, including higher printing pressure, until 10,000 sheets of prints were obtained, the 10000th print obtained using the plate of the present invention had good image quality and no background stain, while the plate of the comparative example D caused background stain in the 7000th print. On the other hand, the plate of the comparative example F caused background stain even in the first print.

In conclusion, only the photoreceptor of the present invention was able to always reproduce clear images even when processed at higher temperature and humidity to provide not less than 10,000 sheets of background stain-free prints.

EXAMPLES 16 TO 25

Electrophotographic photoreceptors were prepared in the same manner as in Example 15, except each of the copolymers set forth in Table 4 were used in the place of the copolymer [XV] as the binder resin of the present invention.

TABLE 4

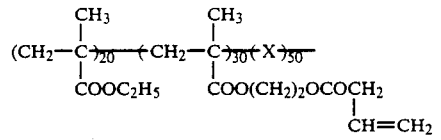

(fraction: by wt %)

| Example | Resin | Chemical Structure of Copolymer Constituent X | Weight Average Molecular Weight |
|---|---|---|---|
| 16 | (XVI) | 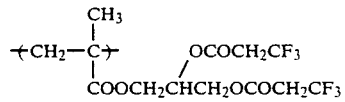 | 53,000 |
| 17 | (XVII) | 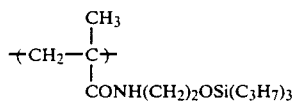 | 49,000 |

TABLE 4-continued

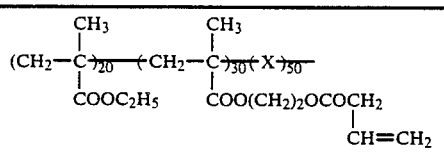

(fraction: by wt %)

| Example | Resin | Chemical Structure of Copolymer Constituent X | Weight Average Molecular Weight |
|---|---|---|---|
| 18 | (XVIII) | 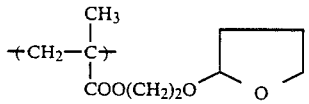 | 55,000 |
| 19 | (XIX) | 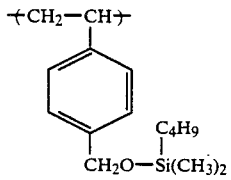 | 45,000 |
| 20 | (XX) | 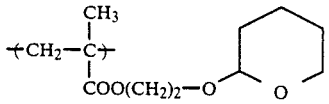 | 52,000 |
| 21 | (XXI) | 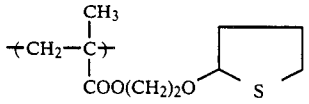 | 53,000 |
| 22 | (XXII) | 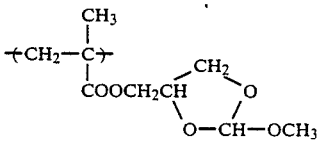 | 50,000 |
| 23 | (XXIII) | 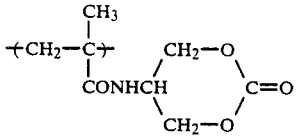 | 52,000 |
| 24 | (XXIV) | 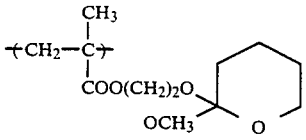 | 49,000 |
| 25 | (XXV) | 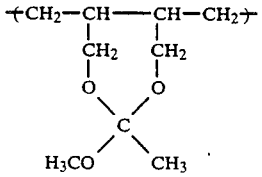 | 60,000 |

These electrophotographic photoreceptors were processed using the same apparatus and the automatic camera processor ELP 404V, as in Example 1. All of the thus obtained masterplates for offset printing had a density of 1.2 or above, and all the images reproduced thereon were clear. After etching processing, the thus obtained printing plates were used to make more than 10,000 sheets of prints in a printing machine. Even after the printing operation was repeated 10,000 times, prints with clear image and no fog in the non-image part were obtained.

On the other hand, the foregoing photoreceptors were allowed to stand at 45° C. and 75% RH for 2 weeks, and then processed in the same manner as described above. In this case, the same results as in the case where the photoreceptors were not subjected to any aging processing were also obtained.

EXAMPLE 26

A photoconductive layer-forming dispersion was prepared by dispersing, in a ball mill for 2 hours, the same composition as in Example 15, except 30 g of the copolymer (XXVI) having the following chemical structure of the present invention (weight average molecular weight of 42,000) was used in the place of the copolymer (XV) used in Example 15:

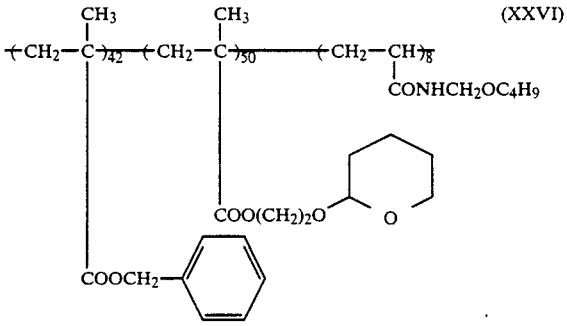

(XXVI)

Subsequently, an electrophotographic photoreceptor was prepared in the same manner as in Example 15.

This electrophotographic photoreceptor was processed with the same apparatus as in Example 1. The thus obtained master plate for offset printing had a density of 1.0 or above, and the image reproduced thereon was clear. After etching processing, the thus obtained printing plate was used to make more than 10,000 sheets of prints in a printing machine. Even after the printing operation was repeated 10,000 times, prints with fog-free, clear image were obtained.

On the other hand, the foregoing photoreceptor was allowed to stand at 45° C. and 75% RH for 2 weeks, and then processed in the same manner as described above. In this case, the same results as in the case where the photoreceptor was not subjected to any aging processing were also obtained.

EXAMPLE 27

An electrophotographic photoreceptor was prepared in the same manner as in Example 26, except the copolymers of this invention (XXVII) and (XXVIII), having the following chemical structures, were used each in the amount of 15 g.

Copolymer (XXVII):

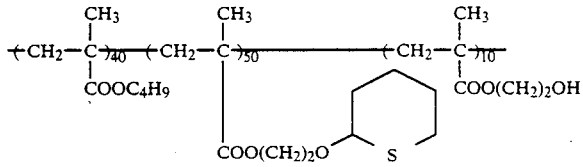

(weight average molecular weight: 43,000)

Copolymer (XXVIII):

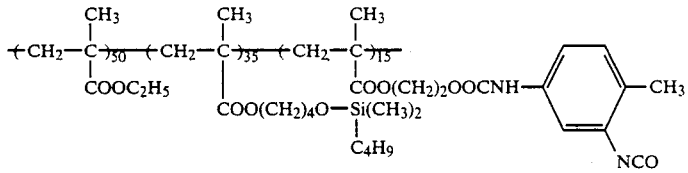

(weight average molecular weight: 38,000)

This electrophotographic photoreceptor was processed with the same apparatus as in Example 1. The thus obtained master plate for offset printing had a density of 1.0 or above, and the image reproduced thereon was clear. After etching processing, the thus obtained printing plate was used to make more than 10,000 sheets of prints in a printing machine. Even after the printing operation was repeated 10,000. times, prints with fog-free, clear image were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor which utilizes an electrophotographic photoreceptor comprising a conductive support having provided thereon at least one photoconductive layer containing photoconductive zinc oxide and a resin binder, said resin binder comprising at least one resin which contains at least one functional group which produces at least one hydroxyl group through decomposition and wherein said resin is partially cross-linked.

2. An electrophotographic lithographic printing plate precursor of claim 1, wherein said resin comprises a copolymer containing at least one copolymer component having at least one functional group which produces at least one hydroxyl group through decomposition and wherein said component has a cross-linking structure prior to copolymerization as to become slightly soluble or insoluble in water when the hydroxyl groups are produced by decomposition.

3. An electrophotographic lithographic printing plate precursor of claim 1, wherein said resin further comprises at least one functional group which undergoes a curing reaction by heat and/or light to partially cross-link the resin.

4. An electrophotographic lithographic printing plate precursor as in claim 2, wherein said resin has a molecular weight of from $5\times10^3$ to $5\times10^5$.

5. An electrophotographic lithographic printing plate precursor as in claim 1, wherein said resin contains at least one functional group having at least two hydroxyl groups located in proximate sterical position so as to be both protected by a single protecting group.

6. An electrophotographic lithographic printing plate precursor as in claim 2, wherein said resin contains at least one functional group having at least two hydroxyl groups located in proximate sterical position so as to be both protected by a single protecting group.

7. An electrophotographic lithographic printing plate precursor as in claim 1, wherein said functional groups is contained in an amount of from about 1 to about 85 wt% based on the total weight of the resin binders.

8. An electrophotographic lithographic printing plate precursor as in claim 2, wherein said copolymer component having a cross-linking structure is present in an amount of from 0.1 to about 10 wt%, when the copolymer component contains polymerizable double bonds, or in an amount of from 1 to 80 wt%, when the copolymer component cross-linkable groups other than the polymerizable double bonds.

* * * * *